166-274

3/1/83 XR 4,375,238 SR

United States Patent [19]

Parsons

[11] 4,375,238

[45] Mar. 1, 1983

[54] METHOD FOR RECOVERY OF OIL FROM RESERVOIRS OF NON-UNIFORM PERMEABILITY

[75] Inventor: Robert W. Parsons, Littleton, Colo.

[73] Assignee: Marathon Oil Company, Findlay, Ohio

[21] Appl. No.: 222,345

[22] Filed: Jan. 5, 1981

[51] Int. Cl.[3] ..... E21B 47/00; E21B 43/22

[52] U.S. Cl. ..... 166/252; 166/274; 166/275

[58] Field of Search ..... 166/252, 268, 273, 274, 166/275

[56] References Cited

U.S. PATENT DOCUMENTS

| | | | |
|---|---|---|---|
| 3,003,554 | 10/1961 | Craig, Jr. et al. | 166/252 X |
| 3,047,063 | 7/1962 | Connally, Jr. et al. | 166/273 |
| 3,294,164 | 12/1966 | Hardy et al. | 166/274 |
| 3,302,710 | 2/1967 | Odeh | 166/252 X |
| 3,363,684 | 1/1968 | Miller | 166/275 |
| 3,500,916 | 3/1970 | van der Knaap et al. | 166/274 X |
| 3,500,917 | 3/1970 | Lehner et al. | 166/274 X |
| 3,661,208 | 5/1972 | Scott et al. | 166/274 |
| 3,687,198 | 8/1972 | Hearn et al. | 166/274 |
| 3,710,861 | 1/1973 | Steeg | 166/273 X |
| 4,241,790 | 12/1980 | Magnie | 166/273 X |

FOREIGN PATENT DOCUMENTS

| | | | |
|---|---|---|---|
| 933906 | 8/1963 | United Kingdom | 166/274 |
| 1021607 | 3/1966 | United Kingdom | 166/268 |

*Primary Examiner*—Stephen J. Novosad
*Assistant Examiner*—George A. Suchfield
*Attorney, Agent, or Firm*—Jack L. Hummel

[57] ABSTRACT

In an oil bearing formation including at least two strata of differing permeabilities oil recovery is enhanced by the controlled injection of a miscible fluid under conditions selected so that the fluid has a density substantially greater than or substantially less than the density which has been determined for the oil in the reservoir in order to encourage gravity segragation of the drive fluid and oil. For example, where it is determined that stratum of lesser permeability is verticially below stratum of greater permeability, a drive fluid having a density substantially greater than the density of the oil results in the gravity segregation of the drive fluid into the lower, less permeable, layer, thereby providing for a subtantially equal drive rate between the more permeable and less permeable layers. In the situation in which it is determined that the less permeable layer is vertically above the more permeable layer the drive fluid is selected to be substantially less dense than the oil in the reservoir, again resulting in the gravity segregation of the drive fluid into the less permeable layer and resulting in the oil being driven through both strata at substantially the same rate. In situations in which the strata are of variably different permeabilities, the cyclic application of drive fluids of substantially greater and substantially lesser densities than the oil in the reservoir results in an efficient sweeping of the oil from all strata in the reservoir. In each of these processes, the pressure of the reservoir is maintained, relative to the temperature and other conditions of the reservoir, so that the drive fluid has the required density.

8 Claims, 6 Drawing Figures

METHOD FOR RECOVERY OF OIL FROM RESERVOIRS OF NON-UNIFORM PERMEABILITY

BACKGROUND OF THE INVENTION

1. Field of the Invention

This invention relates to processes for recovering oil from a reservoir by the injection of miscible drive fluid into the reservoir from longitudinally spaced injection wells. More particularly it relates to the recovery of oil from subterranean reservoirs having strata of differing permeabilities by utilizing a miscible drive fluid selected to have a density such that the drive fluid tends to be forced by gravity into the strata having the lowest permeability.

2. Prior Art

In most oil recovery processes, wells are drilled to subterranean formations containing the oil, and after the formation is thus penetrated, the oil is forced from the petroleum-bearing formation, or reservoir, to a wellbore as a result of the natural gas pressure or hydraulic force within the reservoir, thence to the surface of the earth also by natural pressure or by the use of pumps. Over a period of time, for example, after a substantial volume of oil or gas has been removed from the formation, the natural forces which had been initially driving the oil to the wellbore gradually decrease, sometimes causing the natural flow of oil to stop. However, in most such instances, more oil remains in the reservoir after its initial natural producing energy has declined or stopped than has been recovered from the reservoir. Rather than allow this oil to remain in the ground, it is common to initiate secondary recovery methods like waterflooding, or even tertiary recovery methods to assist in the recovery of the remaining oil. Among these enhanced oil recovery methods are those which have been termed "miscible drive" methods.

In miscible drive methods, a fluid phase is injected into the reservoir and passed through its subterranean formations, more or less horizontally from an input well to one or more output wells. For example, it is well known to inject a fluid which is miscible with oil into a reservoir, and then to inject a driving gas into the reservoir to move both the miscible fluid and the oil towards an output well. In U.S. Pat. No. 3,047,063, it is taught that where an oil reservoir includes zones of different permeability, the oil can be uniformly removed from the different permeability strata by the steps of injecting water into the reservoir, which water is preferentially absorbed into the more permeable zones, followed by injection of an oil miscible fluid, which is in turn followed by the injection of a driving gas which gas is miscible with the miscible fluid phase. The water absorbed into the permeable zone slows the rate of advance of the miscible fluid and driving gas in the more permeable zones, so that the rate of advance is substantially the same in both the more permeable and the less permeable strata. It is thus seen that this recovery method requires three separate injections of different fluids and gases into the well, and for some situations, if too great a pressure is applied, the gas will liquify and reduce or lose its driving force. In other systems, such as in U.S. Pat. No. 3,363,684, it is taught that in secondary recovery it is useful to inject water substantially more dense than the crude oil below the oil-water interface. Thus, for example, injecting dense salt water displaces and floats the less dense crude oil upwards out of a production well. It has been found in practice that this technique leaves a great amount of oil behind due to the fact that salt water is not miscible with oil.

In yet another system, U.S. Pat. No. 3,687,198, it is taught that when carbon dioxide is liquified under pressure, and injected into a reservoir near the oil-water contact under conditions of pressure and temperature such that the liquified carbon dioxide has a density greater than the reservoir oil, but less than encroaching aquifer water, the carbon dioxide is driven substantially upward through the reservoir by the aquifer or injected water. The carbon dioxide then miscibly displaces the oil, driving it to an output well from which it can be removed at the earth's surface. However, this process does not deal with the problems encountered when the reservoir strata includes different permeability materials. In yet another process, as taught in U.S. Pat. No. 3,661,208, carbon dioxide liquified under pressure is continuously injected into a reservoir and maintained at temperature and pressure conditions such that it substantially equals the density of the reservoir oil, thereby avoiding gravity segregation between itself and the oil, and thereby, theoretically, uniformly driving all of the reservoir oil before the miscible liquid carbon dioxide fluid. However, this system does not deal with those all too common situations in which strata of varying permeabilities are encountered within the reservoir. This latter situation results in the less-permeable strata being more or less bypassed by the injected pressurized fluid which seeks the path of least resistance through the more permeable strata, regardless of the fact that the fluid matches the density of the oil in both the permeable and non-permeable layers.

It is therefore seen, that while methods of extracting oil from a reservoir containing strata of varying permeability requiring multiple injections of fluid are known in the prior art, and that methods of injecting a single fluid of a density selected to match, and thereby to displace or drive oil, are also known in the prior art, none of the prior art techniques are suitable or useful for the efficient recovery of oil from a reservoir including strata of varying permeability by a process of injecting a single miscible drive fluid into a reservoir.

SUMMARY OF THE INVENTION

The present invention provides an improved miscible flooding process for the recovery of oil from subterranean reservoirs of the type wherein it has been determined that different strata within the reservoir are of different permeabilities. In this process the density of the miscible drive fluid is intentionally selected, for example by controlling the pressure in the reservoir, relative to the temperature and other conditions to be greater or lesser than the density which has been determined for the oil in the reservoir so that a portion of the drive fluid selectively gravitates to the level of the reservoir containing the less permeable strata, thereby providing a portion of the miscible driving fluid to recover oil from the level of the least permeable strata. In the same process, a proportion of the miscible drive fluid also enters the more permeable strata to recover oil from that layer. Thus the oil is driven through the differentially more permeable and less permeable strata at substantially the same rate.

In situations in which it has been determined that zones of differing permeability are arranged in random order, the process of the present invention is operated by cyclically applying miscible drive fluid which is more dense, and then miscible drive fluid which is less dense than the density which has been determined for the oil in the reservoir to thus effectively sweep the oil from the less permeable zones, regardless of their location.

Other details, objects and advantages of the invention will become apparent from the following detailed description.

DESCRIPTIONS OF THE PREFERRED EMBODIMENTS

Figure 1:
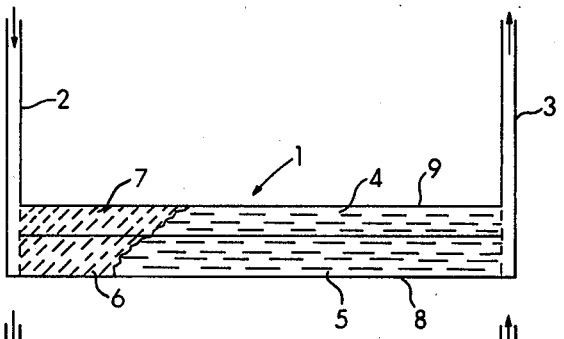
FIG. 1 is a schematic diagram illustrating a subterranean oil reservoir formation in which a more permeable rock stratum is located above a less permeable stratum, at one stage of the process of the present invention.

Referring to FIG. 1, a subterranean formation indicated generally by the numeral 1, is penetrated by input well 2 and a plurality of output wells, of which, for purposes of simplicity of illustration, only output well 3 is shown. The formation, also for purposes of simplicity of description, is indicated as consisting of only two zones, namely upper zone 4 and lower zone 5, each of which has a different permeability to the flow of fluids, such as crude oil. In this example, it will be presumed that it has been determined that zone 4 has a higher permeability to the flow of fluids than zone 5. Further, for purposes of simplicity of illustration, zones 4 and 5 are shown as being of equal thickness. Both zones 4 and 5 contain crude oil of the same determined density. Each of the zones constitute a flow path through the formation from input well 2 to output well 3.

A driving fluid formed of a material which is miscible with the oil in both zones is established in formation 1. This is accomplished by injecting the material, such as carbon dioxide, forming the fluid phase into formation 1 through input well 2. In the situation illustrated in FIG. 1, wherein the less permeable zone 5 is lower than the more permeable zone 4, the miscible drive fluid is chosen, for example by selecting the appropriate pressure relative to the temperature and other conditions so that the drive fluid will have a density substantially greater than the density of the oil in the formation. This causes the material forming the miscible fluid phase to gravitate into the lower zone 5 causing a faster miscible displacement of crude oil in zone 5 than if the miscible fluid were introduced into lower zone 5 only horizontally from injection well 2. The relative rate of advance of the miscible displacing fronts in the zones 4 and 5, then becomes a complex function of vertical and horizontal permeabilities, relative permeabilities, fluid densities, fluid viscosities, and the dimensions of the strata.

However, in each situation, continued injection of the substantially more dense miscible driving fluid into formation 1 through well 2, causes the driving fluid to pass horizontally through the formation in the direction of output well 3. As additional dense fluid is injected into the formation, the dense fluid continues to tend to distribute itself in each of the two layers according to the acting viscous and gravity forces, and the other conditions in the formation. The miscible driving fluid which is intentionally maintained under temperature and pressure conditions so that it will be substantially more dense than the density determined for the oil in the reservoir continues to tend to sink to the lower zone 5, which is less permeable, but the ease of viscous flow through upper, more permeable zone 4 keeps the miscible displacement front moving at a desirable rate through zone 4. Thus, it moves through zone 4 and 5 at substantially the same rate. FIG. 1 illustrates this stage of the procedure.

Figure 2:
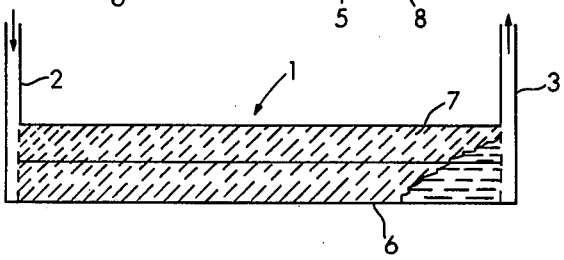
FIG. 2 is a schematic diagram illustrating the subterranean formation of FIG. 1 at another stage of the process of the invention.

Now referring to FIG. 2, with continued injection of miscible fluid which is substantially more dense than the oil into formation 1 from input well 2, miscible drive fluid phases 6 and 7 continue to advance through zones 4 and 5 of formation 1 towards output well 3, displacing oil in both zones and moving it before the drive fluid in the direction of output well 3. Eventually, miscible fluid phases 6 and 7 displace a substantial fraction of the oil, from both zone 5 and zone 4 into output well 3.

During the time that the oil in zones 4 and 5 is being advanced into output well 3, the effluent recovered at the surface of the earth from the output well includes crude oil, gas and water naturally present with the oil in formation 1. At the arrival of miscible fluid phase 6 or 7, at output well 3, the effluent will then consist of the miscible fluid phase, oil, and gas and water with which the oil was naturally associated in the formation. Subsequently, when all the miscible fluid phase along both zones 4 and 5 has reached the output well, substantially, only miscible fluid will be discharged as effluent from output well 3.

At the first breakthrough of the driving miscible fluid from zone 4 into output well 3, conditions within formation 1 will be substantially as illustrated in FIG. 2. The miscible fluid 7 will have occupied nearly all of more permeable zone 4 and will be passing through zone 4 from input well 2 to output well 3 without carrying any substantial amounts of oil, gas or water. At the same time, miscible fluid phase 6 will continue to advance through the formation in zone 5 in the direction of the output well, and this advance will result in the continuous movement of oil present in zone 5 into output well 3.

After the driving miscible fluid has passed completely through one zone, the character of effluent output by well 3 will change and be manifested by an increase in the amount of the driving fluid to the amount of oil produced. Prior to or subsequent to the breakthrough of the miscible fluid into output well 3, as manifested by such a change in the ratio of the amount of driving fluid to the amount of oil in the effluent in the well, injection of driving fluid into formation 1, from input well 2 may be, and is preferably, modified to now provide a more economical drive fluid. However, even after another drive fluid is injected into the reservoir, the pressure, temperature and other conditions of the reservoir are maintained such that the density of the original drive fluid remains more dense than the density of the oil in the reservoir. Drive fluid operations are then continued until economics or other conditions dictate that further production from that reservoir is no longer warranted.

Figure 3:
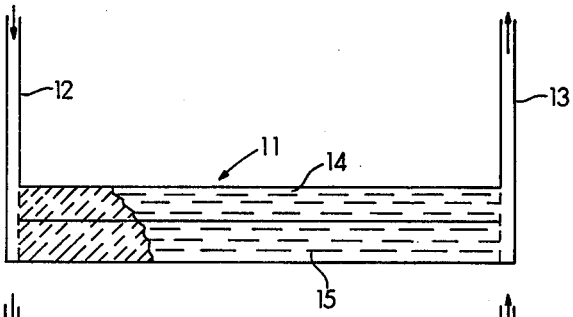
FIG. 3 is a schematic diagram illustrating a subterranean oil reservoir formation in which a less permeable strata is located above a more permeable strata, at one stage of the process of the present invention.
Figure 4:
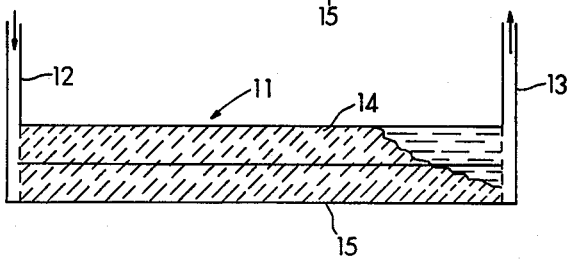
FIG. 4 is a schematic diagram illustrating the subterranean formation of FIG. 3 at another stage of the process of the present invention.

Referring now to FIGS. 3 and 4, a similar process is carried out when it has been determined that the more permeable zone is at the lower level. However, in this instance, the driving fluid and conditions are selected to provide drive fluid having a density substantially less than the determined density of the oil being displaced through the system. Thus, in a similar manner, the driving fluid will have a tendency to migrate or be forced into the higher, but less permeable zone 14 to substantially even out the progression of the miscible displacement fronts in the less permeable and more permeable zones. For example, referring to FIG. 3, subterranean formation 11, is penetrated by input well 12 and representative output well 13. In the formation shown representative upper zone 14 now has a lower permeability to the flow of fluids than representative lower zone 15. Therefore, in the operation of the present invention, miscible drive fluid, such as carbon dioxide, substantially less dense than the determined density of the oil in formation 11 is injected into the formation through input well 12. In the situation illustrated, in which the less permeable zone 14 is above the more permeable zone 15, the choice of a miscible drive fluid which has a substantially lesser density than that of the oil is contemplated to be within the practice and teaching of the present invention. This causes the miscible fluid phase to preferentially gravitate into upper zone 14, even though zone 14 is relatively less permeable than zone 15. Due to the tendency for the drive fluid to also seek the path of least resistance, a portion of the drive fluid tends to flow through the lower, but more permeable zone 15, thus also driving oil in zone 15 towards well 13. Ideally, the rate of advance of the miscible displacing fronts in both zones 14 and 15 are substantially equal. As in the previous example, the density of the drive fluid is controlled by maintaining the reservoir pressure, relative to the temperature and other conditions in the reservoir.

Referring to FIG. 4, at the completion of the sweep of the driving fluid through zone 15, which is shown as having the fastest frontal advance for illustration purposes, the miscible fluid will have occupied nearly all of zone 15 and will be passing into output well 13. Prior to or subsequent to this breakthrough, additional drive fluid may continue to be injected to drive remaining oil from zone 14, or the drive fluid may be modified while maintaining the pressure within the reservoir, to continue injection and production to the practical end of the project.

In the situation wherein it has been determined that there are varied strata in the reservoir, not illustrated, cyclically or randomly injecting miscible drive fluid having, for example, first substantially greater, and then substantially less density than the determined density of the oil, also falls within the practice of the present invention. In this situation, the rising and falling motion of the variably dense miscible drive fluid tends to have a sweeping or agitating action to drive oil from less permeable strata which strata might otherwise be substantially avoided by drive fluid.

Another example of cyclic variation of the drive fluid density involves a drive fluid whose density varies substantially with pressure. Control of injection or production rates or pressures will cause in situ variations of the density of a compressible drive fluid, such as carbon dioxide, due to the accompanying fluctuations of reservoir pressure.

As used herein, substantially greater or lesser density of drive fluid refers to drive fluid which has at least about fifteen percent (15%) greater or lesser density than that of the oil in the reservoir. Variations in density of more than fifteen percent (15%) are also intended to be encompassed within the teaching of the present invention.

Figure 5:
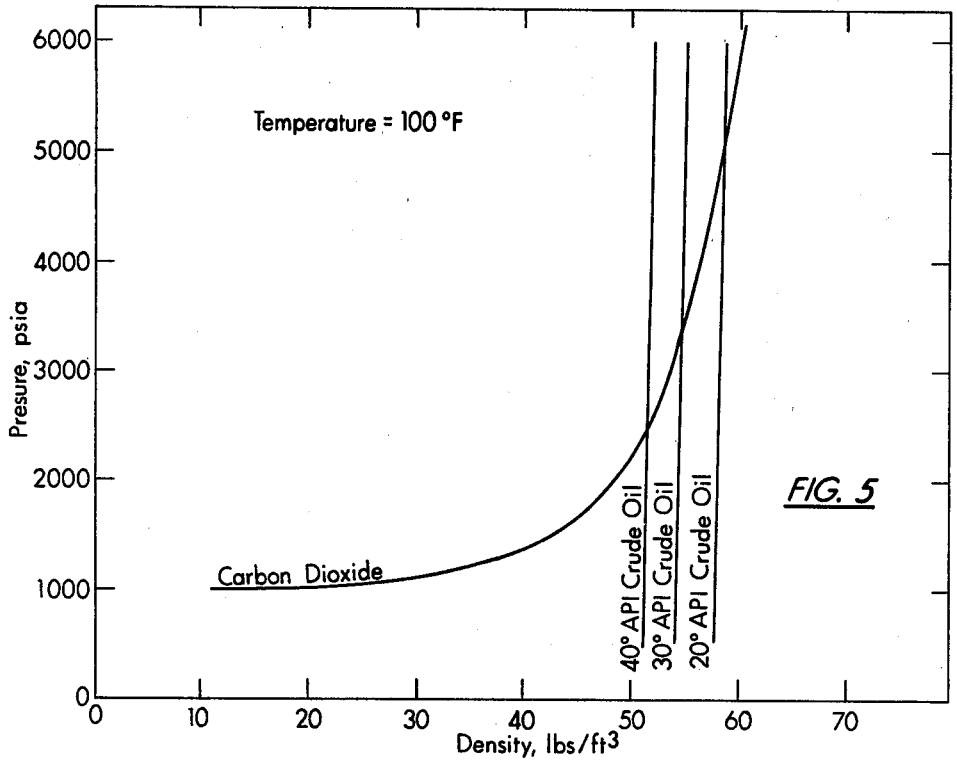
FIGS. 5 and 6 are graphs illustrating three different representative grades of crude oil at varying pressure conditions at 100° F. and 200° F., respectively, and their relationship to the density of carbon dioxide drive fluid under similar temperature and pressure conditions.
Figure 6:
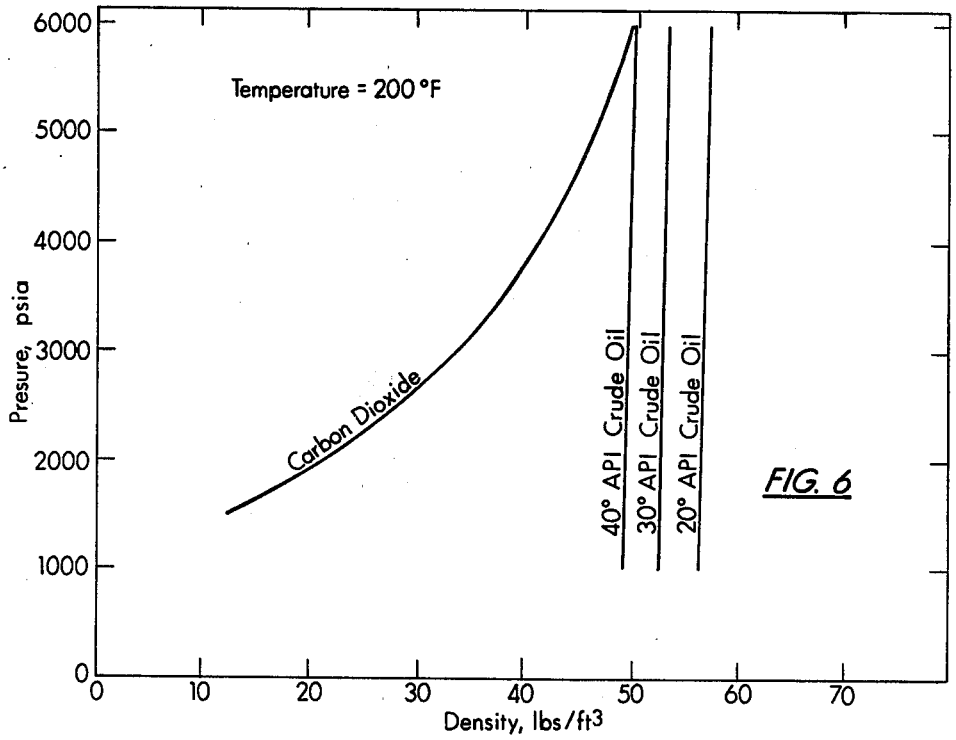

Referring to FIGS. 5 and 6, the characteristics of carbon dioxide, which is one preferred miscible drive fluid are shown in comparison to typical crude oils.

FIG. 5 shows how the density of oils characterized by API gravities of 20°, 30° and 40° varies with pressure at a constant temperature of 100° F. FIG. 6 shows the same relationships, but at 200° F. At 200° F., as shown in FIG. 6, the carbon dioxide density can be substantially less than the crude oil densities for pressures below about 6000 p.s.i.a. Higher densities can be achieved above 6000 p.s.i.a., not shown. For the lower temperature of 100° F., as shown in FIG. 5, the carbon dioxide can be substantially more or less dense than the crude oil depending on the pressure level and the particular crude oil density. Other miscible fluid systems will display different density relationships as a function of pressure and temperature. While carbon dioxide has been shown as the preferred drive fluid, other drive fluids having the required densities can be utilized in the practice of the present invention.

The present invention in its several embodiments provides significant methods for recovering oil from reservoirs having zones of different permeability, which, for lack of the present enhanced recovery process, might be abandoned, or inefficiently recovered. While the foregoing preferred embodiments have been described and illustrated, it is understood that alterations and modifications may be made thereto and fall within the scope of the invention as claimed.

What is claimed is:

1. In a miscible drive fluid process for the recovery of oil of the type wherein miscible fluid consisting essentially of a single oil-miscible fluid is introduced into an oil reservoir and displaces the reservoir oil contained therein to a point where it is removed through a production well to the earth's surface, wherein, when said reservoir includes at least two adjacent oil-containing strata of differing permeabilities, the improvement which comprises:

determining the vertical location of each said stratum of differing permeability relative to one another;

determining the density of the oil in the reservoir and the temperature of the reservoir; and then injecting miscible drive fluid into said reservoir while maintaining the reservoir at such pressure, relative to the temperature and other conditions of the reservoir such that the miscible fluid has a density substantially different from the density of the oil in the reservoir so that the miscible fluid tends to gravitate to the level of the less permeable stratum, to displace oil from that stratum and from the more permeable stratum at substantially the same rate.

2. The process of claim 1 in which the less permeable layer is vertically below the more permeable layer and in which the miscible drive fluid and pressure are selected to have a density substantially greater than the density of the oil in the reservoir.

3. The process of claim 1 wherein the less permeable layer is vertically above the more permeable layer in the reservoir and in which the miscible drive fluid and pressure are selected to have a density substantially less than the density of the oil in the reservoir.

4. The method of claim 1 wherein layers of varying permeability are randomly located throughout the reservoir and in which the drive fluid and pressure are varied so that the drive fluid is intermittently substantially more dense and then substantially less dense than the density of the oil in said reservoir.

5. The process of claim 1 in which the density of the miscible drive fluid is maintained a minimum of at least fifteen percent (15%) greater or lesser than the density of the reservoir oil.

6. The process of claim 1 in which the miscible drive fluid is carbon dioxide.

7. The process of claim 1 in which a driving fluid other than the miscible drive fluid is injected after the miscible drive fluid, while maintaining the pressure within the reservoir.

8. The process of claim 7 in which the other driving fluid is injected after stratum of one permeability has been completely swept by the miscible drive fluid.

* * * * *